US006352188B1

(12) United States Patent
Piccinino, Jr. et al.

(10) Patent No.: US 6,352,188 B1
(45) Date of Patent: Mar. 5, 2002

(54) EDGE DRIVE FOR PHOTOSENSITIVE MEDIA

(75) Inventors: Ralph L. Piccinino, Jr., Rush; Kevin H. Blakely, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/631,161

(22) Filed: Aug. 3, 2000

(51) Int. Cl.[7] ..... B65H 26/00; B65H 20/00

(52) U.S. Cl. ..... 226/19; 226/179; 226/190; 242/615.1

(58) Field of Search ..... 226/19, 179, 189, 226/190; 242/615.1

(56) References Cited

U.S. PATENT DOCUMENTS 1,854,004 A * 4/1932 Tschopp ..... 226/179
2,297,236 A * 9/1942 Nadai et al. ..... 226/190 X
2,358,065 A * 9/1944 Hale ..... 226/179 X
2,473,599 A * 6/1949 Liebel ..... 226/179 X
2,706,625 A 4/1955 Lorig
2,871,011 A * 1/1959 Hercik ..... 226/179
2,979,829 A 4/1961 Uhleen
3,642,229 A 2/1972 Downey et al.
4,174,104 A 11/1979 Garvey
5,087,318 A * 2/1992 Anderson ..... 226/19 X
5,213,246 A 5/1993 Crowley
5,244,138 A 9/1993 Blanding et al.
5,271,542 A * 12/1993 Yamamoto ..... 226/179 X
5,501,386 A * 3/1996 Kobayashi ..... 226/190
5,551,619 A * 9/1996 Narron ..... 242/615.1 X

* cited by examiner

*Primary Examiner*—Michael R. Mansen
(74) *Attorney, Agent, or Firm*—Frank Pincelli

(57) ABSTRACT

A transport mechanism for transporting photographic media along a processing path. The mechanism includes a roller assembly having a pair of space support roller assemblies disposed along a common shaft. Each pair of roller assemblies having a support roller having an outer engaging surface. A spring is provided for biasing the contact surface toward the edge of the media and a retaining member for restraining movement of each of the roller assemblies on the shaft.

11 Claims, 4 Drawing Sheets

EDGE DRIVE FOR PHOTOSENSITIVE MEDIA

FIELD OF THE INVENTION

The present invention is directed to transporting mechanisms for transporting of media along a processing path. More particularly to a transport mechanism designed to transport media without touching the top surface thereof.

BACKGROUND OF THE INVENTION

It has been found desirable to apply a coating onto a photographic media, such as photographic paper after it has been processed. It has been found that when the appropriate coating is provided, improved performance of the media may be obtained. The coating is applied in a liquid form and thereafter dried either by blowing air, by heating, or by a combination of the two. A problem with such device is that it is important that there be no contact on the surface of the media that has just received the coating prior to drying or just after drying. Thus there is a need to provide a transport system for photographic prints in sheet or web form which will not disturb the coating side of the print.

SUMMARY OF THE INVENTION

In accordance with one aspect of the present invention there is provided a transport mechanism for transporting media along a processing path, comprising:

a roller assembly having a pair of space support roller assemblies disposed along a common shaft, each pair of roller assemblies having a support roller having an outer engaging surface, a spring for biasing the contact surface toward the edge of the media and a retaining member for restraining movement of each of the roller assemblies on the shaft.

In accordance with another aspect of the present invention there is provided a transport mechanism for transporting media along a processing path, comprising:

a roller assembly having a pair of space support roller assemblies disposed along a common shaft, each pair of roller assemblies having a support roller having an outer engaging surface having a first cylindrical portion and a second angular section forming a transition seat there between, a spring for biasing the engaging surface toward the edge of the media and a retaining member for restraining movement of each of the roller assemblies on the shaft.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
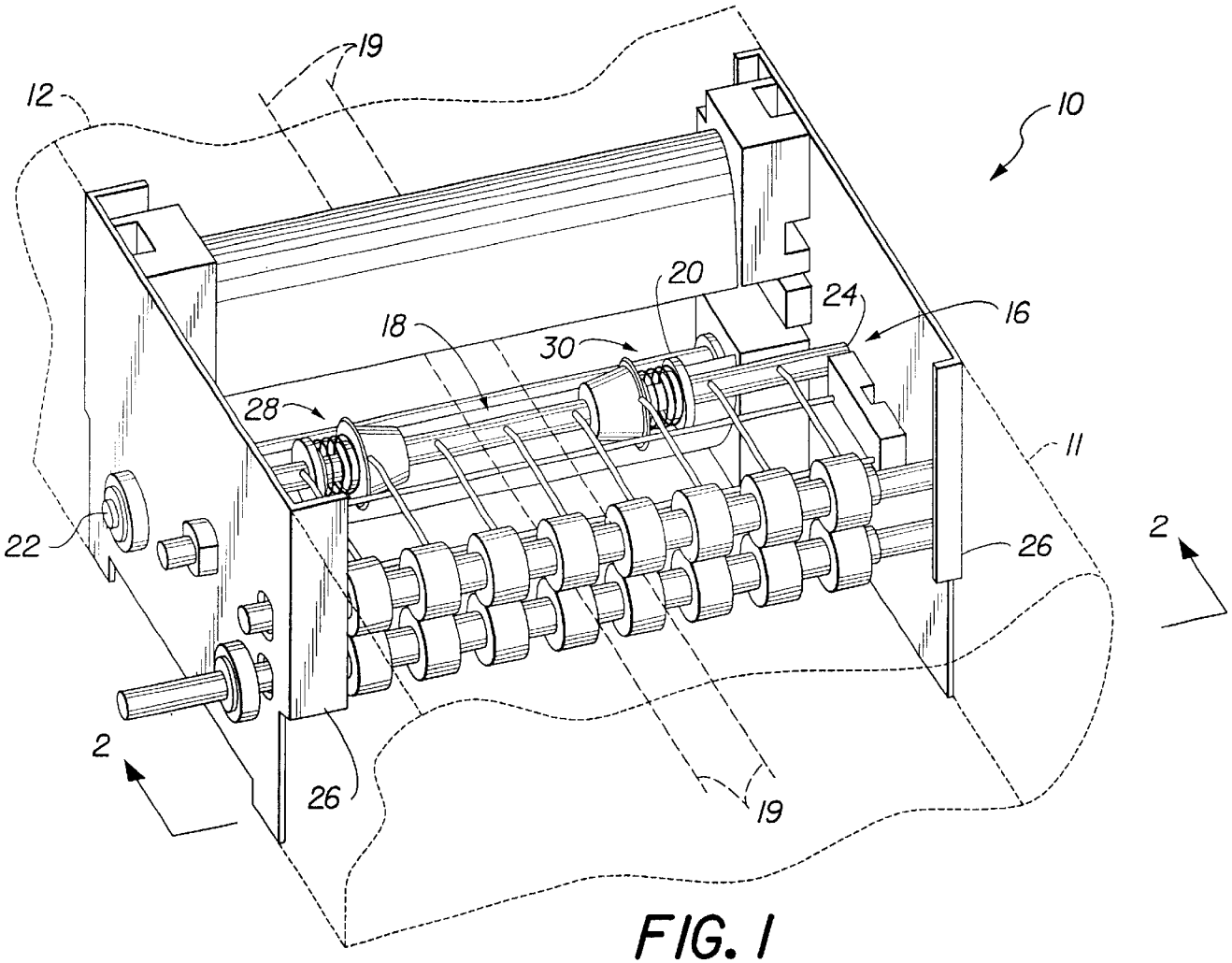
FIG. 1 is a perspective view of a transport mechanism made in accordance with the present invention.
Figure 2:
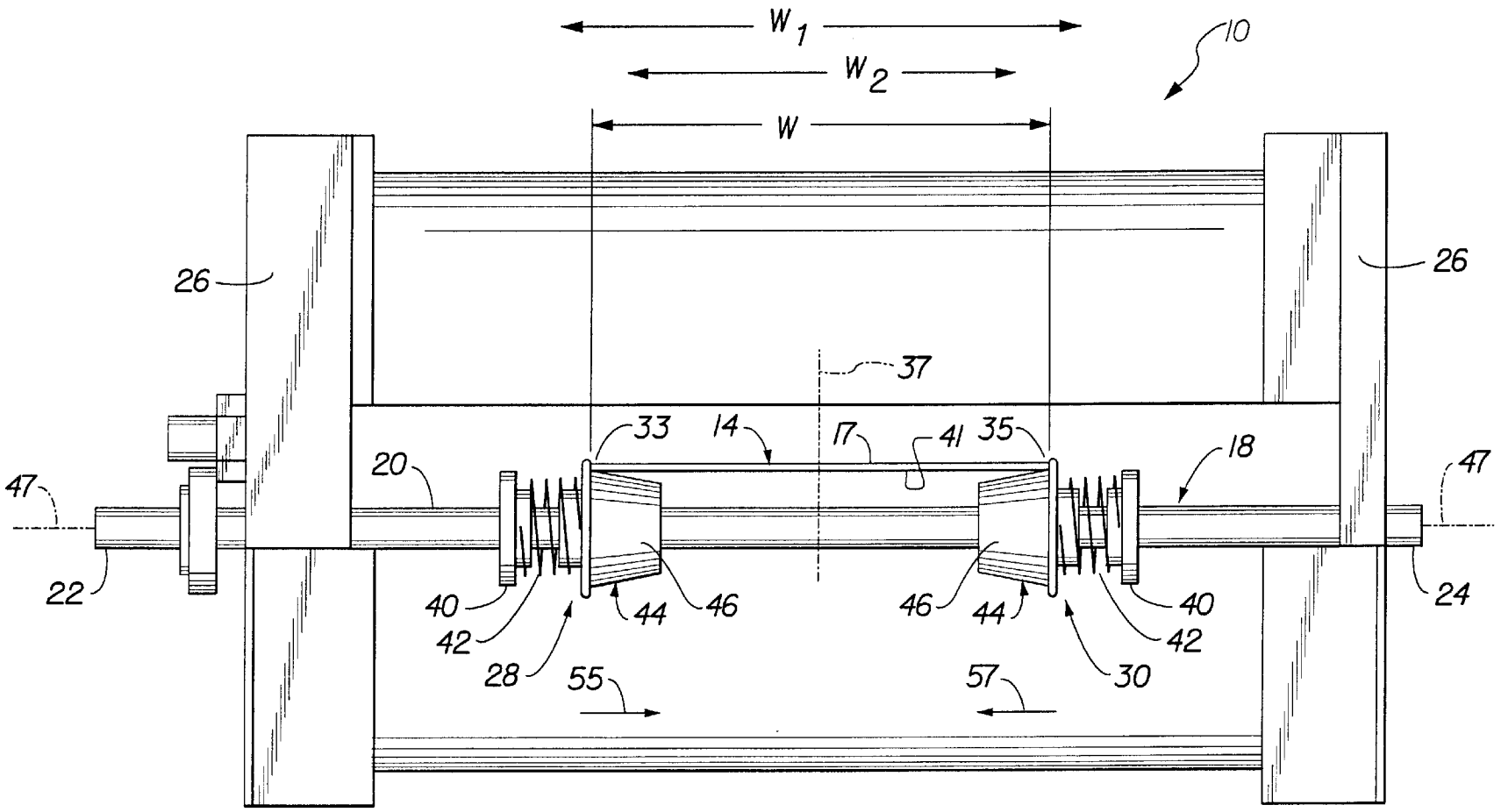
FIG. 2 is an elevational view of the apparatus FIG. 1 that is taken along line 2—2 thereof.

Referring to FIGS. 1 and 2 there is illustrated a transport mechanism made in accordance with the present invention for use in a photofinishing apparatus (not shown) or in conjunction with as coating apparatus as disclosed in U.S. Pat. 6,092,303, entitled APPARATUS AND METHOD FOR DRYING PHOTOSENSITIVE MATERIAL USING A RADIANT HEAT SECTION AND AN AIR FLOW SECTION by Ralph Piccinino, Jr. et al. and U.S. Pat. application Ser. No. 09/082,957 filed May 21, 1998 entitled A METHOD AND APPARATUS FOR APPLYING A SOLUTION TO PHOTOSENSITIVE MATERIAL by Ralph Piccinino, Jr. et al. which are both hereby incorporated by reference. Typically transport mechanism 10 would be provided downstream of a coating apparatus 12 such as described in the co-pending US applications for coating a photographic media 14 such as photographic paper. The coating apparatus 12 is illustrated by dash lines in FIG. 1. The transport mechanism 10 may be provided just after the coating apparatus or just after the drying section 11, shown in dash lines, of the coating apparatus 12 as illustrated by FIG. 1. The coating side of the media while still in these areas is quite susceptible to damage.

The transport mechanism 12 includes at least one transport roller assembly 16 which is designed to receive a web or cut sheet of media 14 which has passed for example, through a coating apparatus 12 whereby a coating have placed on the top surface 17. In the particular embodiment illustrated a single drive roller assembly 18 is illustrated for moving the media along a processing path 19. However, it is to be understood any desired number of roller assemblies 18 may be provided. The roller assembly 18 includes a drive shaft 20 which has a pair of lateral ends 22, 24 rotatably mounted to frame 26. The end 22 of drive shaft 20 is also connected to a drive train (not shown) for rotating of shaft 20 at the appropriate speed and direction. It is to be understood that any desired drive train and/or mode of drive may be used for rotating of shaft 20.

A pair of spaced mounted drive roller assemblies 28, 30 are provided on shaft 20 for engaging the lateral sides 33, 35 of media 14 as illustrated by FIG. 2. The drive roller assemblies 28 and 30 are identical except that they are mirror images of each other and are disposed adjacent lateral sides 33, 35 of media 14 on opposite sides of centerline 37. The drive assemblies 28, 30 each include a stationary member 40 which is secured to the shaft 22, a spring 42 and drive roller 44. The drive rollers 44 are each mounted to shaft 20 such that it rotates with shaft 20 but is free to move along the longitudinal axis 47 of shaft 20 in accordance with the biasing affect of spring 42. Each roller 44 has an engaging surface 46 designed to engage and drive either the bottom surface 41 or later sides 33, 35 of the photosensitive media 14 such that the top surface 17 of the photosensitive media 14 having the coating does not come in contact with the rollers 44. The engaging surface 46 is made of a material for providing sufficient friction between the engaging surface 46 and media 14 such the media 14 will be driven along the processing path 19. In the embodiment illustrated, engaging surface 46 is made of a rubber material. The spring 42 of each assemblies 28, 30 bias and causes the surface support rollers 44 to be bias toward the sides 33, 35 as indicated by arrows 55, 57 respectively. The springs 42 each provide a sufficient amount of force such that contact is provided with media 14 for moving of the photosensitive media 14 but not too great as to cause undue deformation of the photosensitive media 14. It is of course to be understood that the size and strength of springs 42 can vary in accordance with the type and size of photosensitive media 14 being transported.

In the particular embodiment illustrated, photosensitive media 14 is photographic paper having a width W which may range from a width W1 to W2. In addition, the variation in width in which the roller assemblies may accept media may vary as desired in accordance with the configuration of the rollers 44 and strength of the springs. In the particular embodiment illustrated, the roller drive assemblies 28, 30 are designed such that the photosensitive media 14 may have a width ranging from approximately 4 inches to approximately 6 inches. As is well known, photosensitive media for any particular size may vary slightly in width along the length of the media, especially if a continuous web is being transported. By providing the roller drive assemblies made with springs that are biased toward the center of the photosensitive media it is possible to provide positive transport of media 14 without touching of the top surface 17 thereof.

Figure 3:
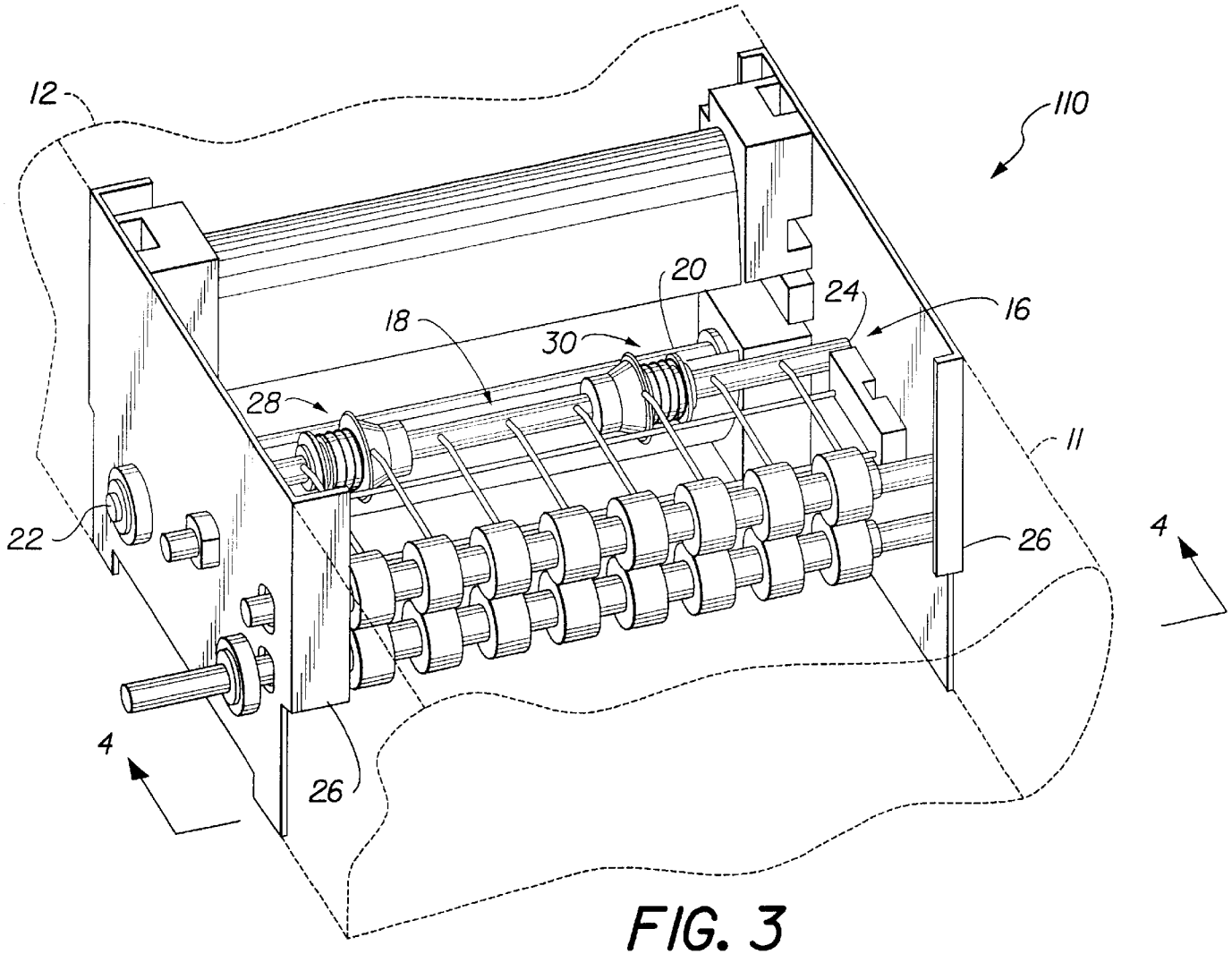
FIG. 3 is a perspective view of a vice similar to that of FIG. 1 illustrated modified form of the present invention.
Figure 4:
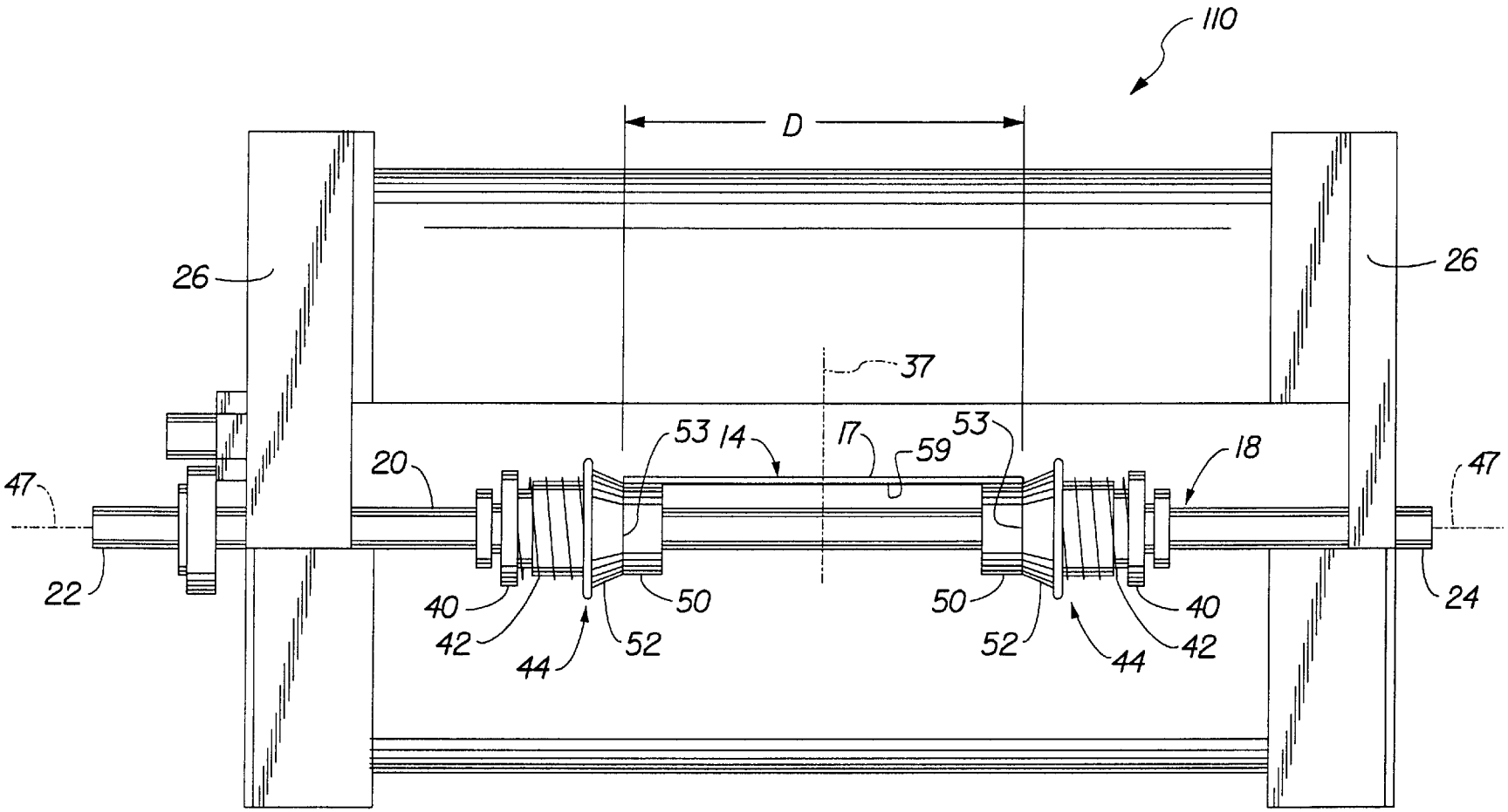
FIG. 4 is an elevational view of the apparatus FIG. 3 that is taken along line 4—4 thereof.

Referring to FIGS. 3 and 4 there is illustrated a modified transport mechanism 110 made in accordance with the present invention like numerous indicating like parts and operation as previously discussed. In this embodiment the contact surface of the rollers 44 each have a first cylindrical support surface 50 and an adjacent angular support surface 52. A transition seat 53 is formed at the juncture surfaces 50, 52. Support surface 50 is designed to support the bottom surface 59 of the media 14 while the transition seat 53 and angular support surface 52 will drive the media. The distance D between the seats 53 of each of the opposed rollers 42 on shaft 20 is designed to be substantially the same as the width W of the photosensitive media 14 passing therebetween. The springs 42 are such that the edges of media 14 will be captured at the transition seat 53. This type construction provides vertical support for the bottom surface 41 of media 14 by surfaces 50 as illustrated by FIG. 4 and a sufficient degree of axial force along the edge for transporting of the media 14 along the processing path.

It is to be understood that various modifications and changes may be made without departing from the scope of the present invention. The present invention being defined by the following claims:

What is claimed is:

1. A transport mechanism for transporting media along a processing path, comprising;

a roller assembly having a pair of space support drive roller assemblies disposed along a common shaft, each pair of roller assemblies having a support roller having an outer engaging surface, a spring for biasing said contact surface toward the edge of said media and a retaining member for restraining movement of each of said roller assemblies on said shaft.

2. A transport mechanism according to claim 1 wherein said engaging surface is made of a rubber material.

3. A transport mechanism according to claim 1 wherein said media comprises a photographic media.

4. A transport mechanism according to claim 3 wherein a coating has just been applied to said photographic media.

5. A transport mechanism according to claim 4 wherein said photographic media comprises photographic paper.

6. A transport mechanism for transporting media along a processing path, comprising;

a roller assembly having a pair of space support roller assemblies disposed along a common shaft, each pair of roller assemblies having a support roller having an outer engaging surface having a first cylindrical portion and a second angular section forming a transition seat there between, a spring for biasing said engaging surface toward the edge of said media and a retaining member for restraining movement of each of said roller assemblies on said shaft.

7. A transport mechanism according to claim 6 wherein the distance between the transition seat between said roller assemblies being substantially equal to the width of the photosensitive media passing there through, said springs being designed so as to conform the support rollers to the media passing through.

8. A transport mechanism according to claim 6 wherein said engaging surface is made of rubber material.

9. A transport mechanism according to claim 6 wherein said media comprises a photographic media.

10. A transport mechanism according to claim 9 wherein a coating has been applied to said photographic media.

11. A transport mechanism according to claim 10 wherein said photographic media comprises photographic paper.

* * * * *